US008347455B2

(12) United States Patent
Dyson et al.

(10) Patent No.: US 8,347,455 B2
(45) Date of Patent: Jan. 8, 2013

(54) CLEANING APPLIANCE

(75) Inventors: James Dyson, Malmesbury (GB); Richard Morgan Hickmott, Malmesbury (GB); Peter David Gammack, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 696 days.

(21) Appl. No.: 12/307,529

(22) PCT Filed: Jul. 5, 2007

(86) PCT No.: PCT/GB2007/002524

§ 371 (c)(1),
(2), (4) Date: Jul. 24, 2009

(87) PCT Pub. No.: WO2008/009883

PCT Pub. Date: Jan. 24, 2008

(65) Prior Publication Data

US 2010/0229321 A1 Sep. 16, 2010

(30) Foreign Application Priority Data

Jul. 18, 2006 (GB) ..... 0614235.0

(51) Int. Cl.
*A47L 5/02* (2006.01)

(52) U.S. Cl. ..... 15/353; 15/327.2; 15/327.7; 15/344; 15/DIG. 1

(58) Field of Classification Search ..... 15/327.1, 15/327.2, 344, 353, DIG. 1, 410; *A47L 5/02*
See application file for complete search history.

(56) References Cited

U.S. PATENT DOCUMENTS

| | | | |
|---|---|---|---|
| 1,871,624 | A | 8/1932 | Loewinsohn |
| 3,914,820 | A | 10/1975 | Hankel |
| 5,074,006 | A | 12/1991 | Eremita |
| 5,089,738 | A | 2/1992 | Bergqvist et al. |
| 2002/0096341 | A1 | 7/2002 | Hagan et al. |
| 2002/0189048 | A1 | 12/2002 | Maruyama et al. |
| 2003/0030984 | A1 | 2/2003 | Fung |
| 2004/0144070 | A1 | 7/2004 | Gammack et al. |
| 2009/0265877 | A1 | 10/2009 | Dyson et al. |

FOREIGN PATENT DOCUMENTS

| | | |
|---|---|---|
| DE | 20202595 | 8/2002 |
| EP | 1523916 | 4/2006 |
| FR | 1508452 | 1/1968 |

(Continued)

OTHER PUBLICATIONS

Japanese Exam Report dated Oct. 18, 2010 directed towards corresponding Application No. 2009-520026; 2 pages.

(Continued)

*Primary Examiner* — David Redding
(74) *Attorney, Agent, or Firm* — Morrison & Foerster LLP

(57) ABSTRACT

A hand-held cleaning appliance includes a suction conduit, an airflow generator for generating an airflow along the suction conduit, a separating apparatus in communication with the suction conduit for separating dirt and dust from the airflow, a power source for supplying power to the airflow generator and a handgrip enabling a user to maneuver the hand-held cleaning appliance. The handgrip has a first end and a second end. The airflow generator is arranged directly adjacent the first end of the handgrip and the power source is arranged adjacent the second end of the handgrip. By providing a hand-held vacuum cleaner with such an arrangement, the hand-held vacuum cleaner is easier and more comfortable to manipulate in use.

27 Claims, 3 Drawing Sheets

FOREIGN PATENT DOCUMENTS

| | | |
|---|---|---|
| GB | 795118 | 5/1958 |
| GB | 1207278 | 9/1970 |
| GB | 2137896 | 10/1984 |
| GB | 2276311 | 9/1994 |
| JP | 50-147166 | 11/1975 |
| JP | 54-27573 | 2/1979 |
| JP | 57-112745 | 7/1982 |
| JP | 62-34523 | 2/1987 |
| JP | 62-254725 | 11/1987 |
| JP | 62-290431 | 12/1987 |
| JP | 63-296718 | 12/1988 |
| JP | 5-192270 | 8/1993 |
| JP | 6-68654 | 9/1994 |
| JP | 2002-85297 | 3/2002 |
| JP | 2004-41760 | 2/2004 |
| JP | 2004-351234 | 12/2004 |
| JP | 2005-80975 | 3/2005 |

OTHER PUBLICATIONS

British Search Report completed on Oct. 9, 2006 directed towards foreign application No. GB0614235.0; 1 page.

International Search Report and Written Opinion mailed on Sep. 19, 2007 directed towards international application No. PCT/GB2007/002524; 13 pages.

International Preliminary Report on Patentability completed on Jul. 25, 2008 directed towards international application No. PCT/GB2007/002524; 5 pages.

International Preliminary Report on Patentability completed on Sep. 24, 2008 directed towards international application No. PCT/GB2007/002536; 6 pages.

CLEANING APPLIANCE

REFERENCE TO RELATED APPLICATIONS

This application is a national stage application under 35 USC 371 of International Application No. PCT/GB2007/002524, filed Jul. 5, 2007, which claims the priority of United Kingdom Application No. 0614235.0, filed Jul. 18, 2006, the contents of which prior applications are incorporated herein by reference.

FIELD OF THE INVENTION

The invention relates to a hand-held cleaning appliance. More particularly, the invention relates to a hand-held vacuum cleaner.

BACKGROUND OF THE INVENTION

Hand-held vacuum cleaners are known from, for example, GB 1 207 278. This document discloses a hand-held vacuum cleaner having an elongate main body with an air inlet, a suction conduit and a dust bag for separating dirt and dust from an airflow. A motor and fan assembly is provided in the main body together with a power source. A handgrip is located on the upper part of the hand-held vacuum cleaner. The handgrip extends parallel to the elongate main body at a shallow angle to the suction conduit, and both the airflow generator and the power source are located in the main body underneath the handgrip. JP 2004-041760 discloses a hand-held vacuum cleaner having a similar handgrip arrangement. However, in this case, the motor and fan assembly and the power source of the hand-held vacuum cleaner are arranged so that the centre of gravity of the machine is located at the centre of the handgrip.

An alternative arrangement of handgrip is shown in U.S. Pat. No. 1,871,624. This document discloses a hand-held vacuum cleaner having a cylindrical main body and a handgrip arranged at one end. A curved suction conduit is located at an end opposite to the handgrip. The handgrip is arranged transversely to the longitudinal axis of the cylindrical main body and approximately parallel to the suction conduit. This arrangement may give the user a stronger wrist position in use than the handgrip arrangements disclosed in GB 1 207 278 and JP 2004-041760. However, the heavy components of the vacuum cleaner (for example, the motor and fan assembly) are located forwardly of the handgrip relative to a user's hand when the vacuum cleaner is in use. Therefore, the centre of mass of the respective hand-held vacuum cleaner will be located forwardly of the handgrip. This may result in the hand-held vacuum cleaner described above being tiring and uncomfortable to use because the user will have to exert additional effort in order to maintain the hand-held vacuum cleaner in a fixed orientation.

SUMMARY OF THE INVENTION

It is an object of the present invention to provide a hand-held vacuum cleaner which is easier to manipulate in use than known arrangements. It is a further object of the present invention to provide a hand-held vacuum cleaner in which the arrangement of the handgrip, the motor and fan assembly and the power source allow the hand-held vacuum cleaner to be manipulated easily and comfortably.

The invention provides a hand-held cleaning appliance comprising a suction conduit, an airflow generator for generating an airflow along the suction conduit, separating apparatus in communication with the suction conduit for separating dirt and dust from the airflow, a power source for supplying power to the airflow generator and a handgrip for enabling a user to manoeuvre the hand-held cleaning appliance, the handgrip having a first end and a second end, wherein the airflow generator is arranged directly adjacent the first end of the handgrip and the power source is arranged adjacent the second end of the handgrip. By providing such an arrangement, when a user grips the handgrip, the small resulting moment between the centre of mass of each of these components and the user's hand results in a hand-held vacuum cleaner which is easier to manipulate in use.

Preferably, the power source is arranged directly adjacent the second end of the handgrip. This arrangement allows the hand-held vacuum cleaner to be used easily and comfortably by a user.

Preferably, the handgrip has a longitudinal axis which passes through at least a part of the airflow generator. More preferably, the handgrip has a longitudinal axis which passes through at least a part of the power source.

Preferably, the suction conduit has a suction opening which is located remote from the handgrip. More preferably, the separating apparatus is located between the suction opening and the handgrip. Such an arrangement is compact and convenient to use.

BRIEF DESCRIPTION OF THE DRAWINGS

An embodiment of the invention will now be described with reference to the accompanying drawings, in which.

DETAILED DESCRIPTION OF THE INVENTION

Figure 1:
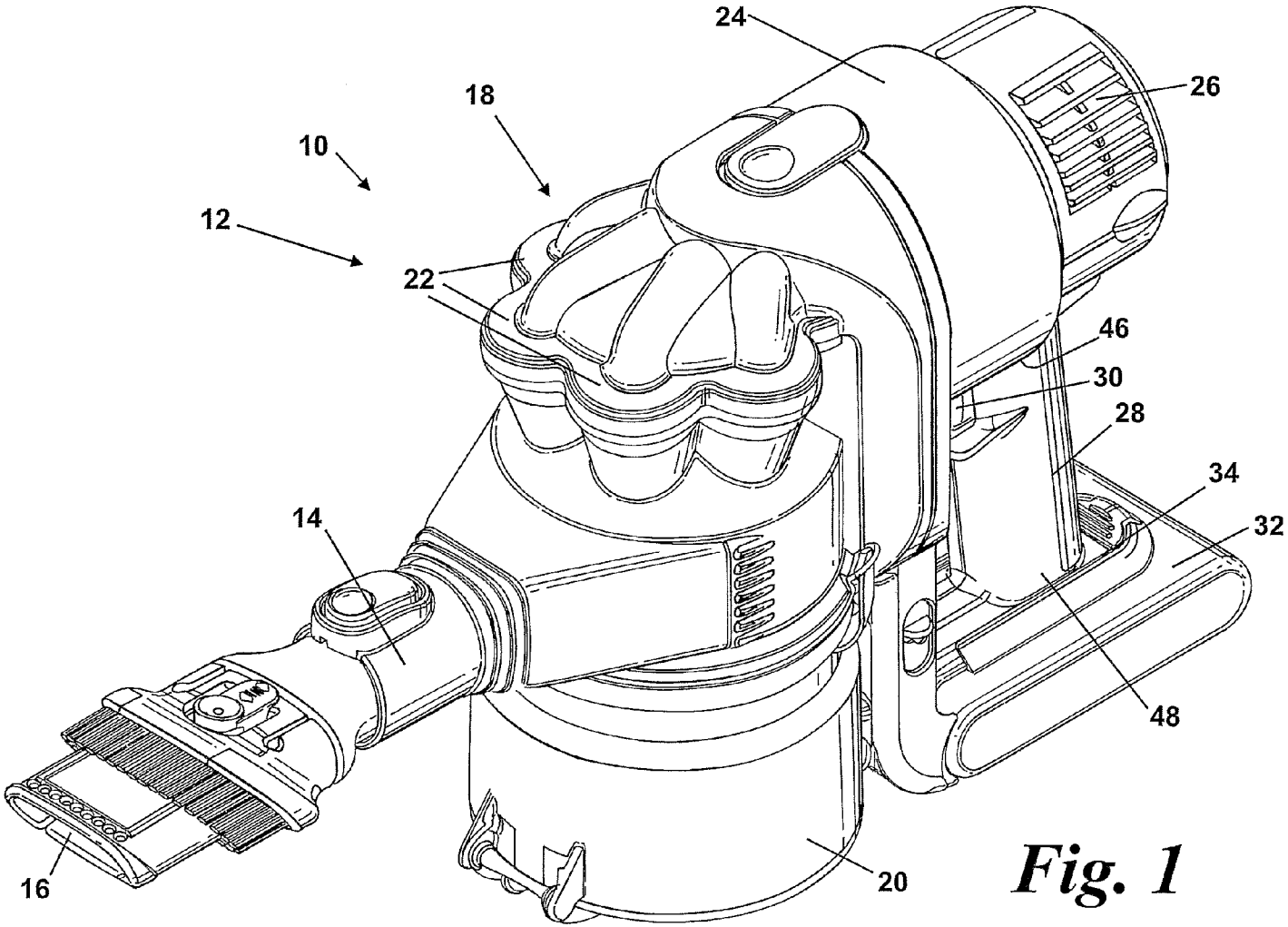
FIG. 1 is an isometric view of a hand-held vacuum cleaner according to the invention.

FIG. 1 shows a hand-held vacuum cleaner 10. The hand-held vacuum cleaner 10 comprises a main body 12. The main body 12 includes a suction conduit 14 having a suction opening 16. The main body 12 also includes cyclonic separating apparatus 18 for separating dirt and dust from an airflow drawn in through the suction opening 16. The cyclonic separating apparatus 18 is in communication with the suction conduit 14 and the suction opening 16. The cyclonic separating apparatus 18 comprises an upstream cyclone 20 and a plurality of downstream cyclones 22 but further detail is not material to the invention and therefore will not be described.

The main body 12 further includes a motor housing 24 having a plurality of exhaust vents 26 formed therein. A flowpath extends from the suction opening 16, through the suction conduit 14, the cyclonic separating apparatus 18 and the motor housing 24 to the exhaust vents 26. A handgrip 28 is located below the motor housing 24 for manipulating the hand-held vacuum cleaner 10 when in use. The handgrip 28 is arranged so that the cyclonic separating apparatus 18 is located between the handgrip 28 and the suction opening 16. The handgrip 28 includes a trigger switch 30 which is positioned on the side of the handgrip 28 closest to the suction opening 16 such that the trigger switch 30 can be manipulated by a user's index finger. A power source 32 is connected to the handgrip 28 through a mounting portion 34.

Figure 2:
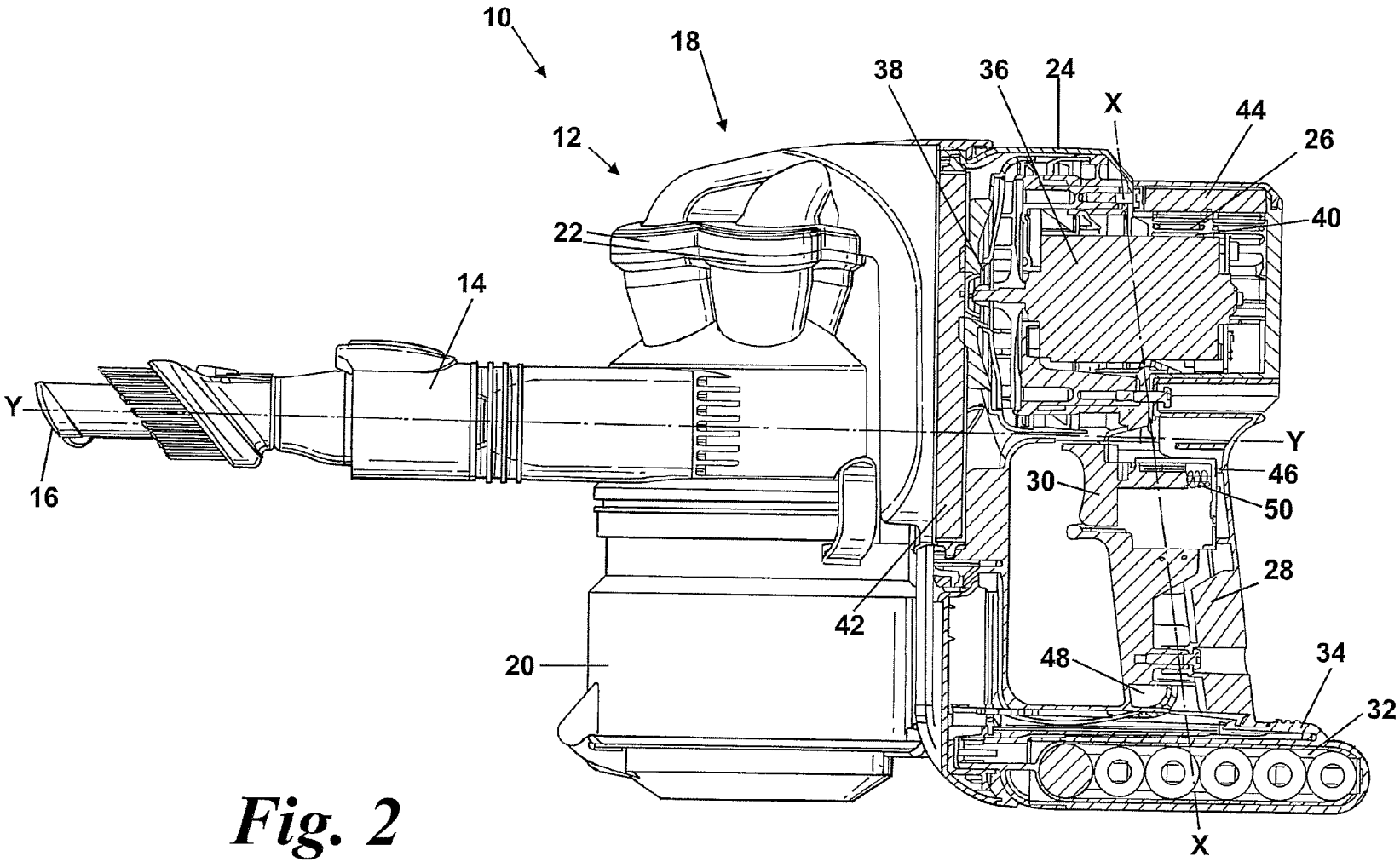
FIG. 2 is a partially cut-away side view of the hand-held vacuum cleaner of FIG. 1.
Figure 3:
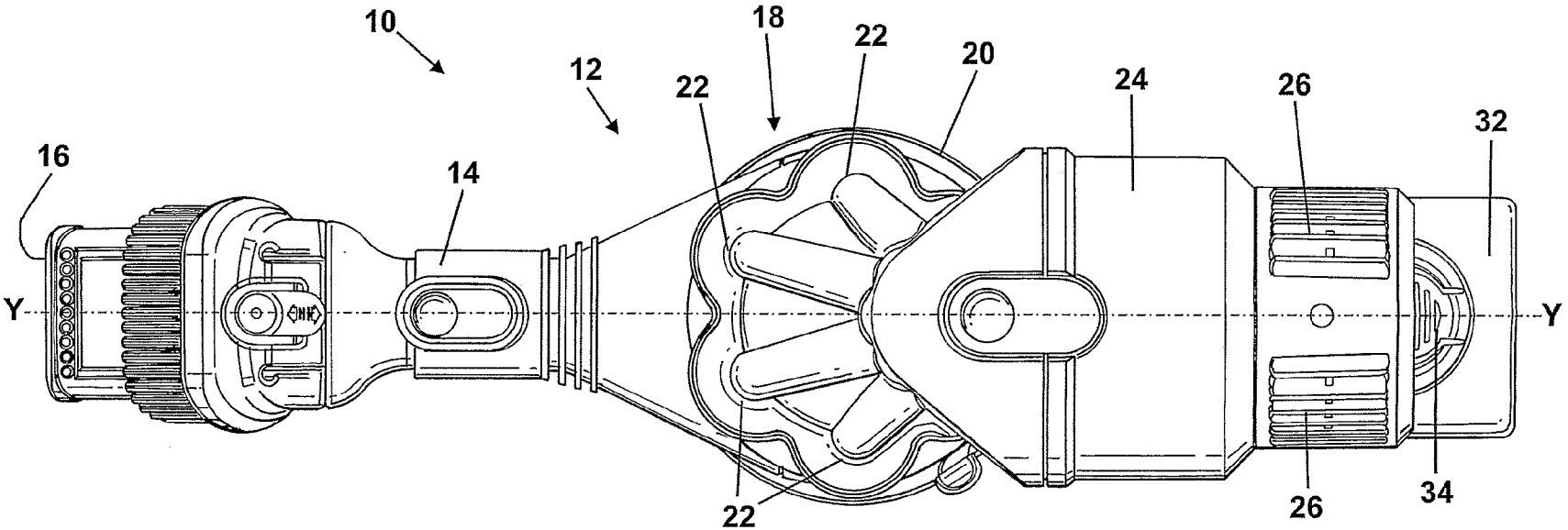
FIG. 3 is a plan view of the hand-held vacuum cleaner of FIG. 1.

FIG. 2 shows the hand-held vacuum cleaner 10 in more detail. An airflow generator 36 is located in the motor housing 24. In this embodiment, the airflow generator 36 takes the form of a motor and fan assembly. The airflow generator 36 has an inlet 38 and an outlet 40. A pre-motor filter 42 is located upstream of the inlet 38 for filtering fine particulates from the airflow. A post-motor filter 44 is located downstream of the outlet 40. The pre-motor filter 42 and the post-motor filter 44 are located in the flowpath.

The handgrip 28 takes the form of an elongate handle and has a first end 46, a second end 48 and an axis X-X. The first end 46 of the handgrip 28 is connected to the motor housing 24. The airflow generator 36 is located adjacent the first end 46 of the handgrip 28. In this embodiment, the handgrip 28 and the airflow generator 36 are arranged such that the axis X-X of the handgrip 28 passes through at least a part of the airflow generator 36.

The mounting portion 34 removably receives the power source 32. When fitted to the hand-held vacuum cleaner 10, the power source 32 is located directly adjacent the second end 48 of the handgrip 28. In this embodiment, the power source 32 and the handgrip 28 are arranged so that the axis X-X passes through at least a part of the power source 32.

In other words, the handgrip 28 is arranged to lie between the airflow generator 36 and the power source 32. In this embodiment, the axis X-X passes through at least a part of each of the airflow generator 36 and the power source 32. Further, the axis X-X of the handgrip 28 lies transverse to a longitudinal axis Y-Y of the suction conduit 12. The longitudinal axis Y-Y passes through the suction opening 16. In this embodiment, the axis X-X is arranged at an angle to the longitudinal axis Y-Y which is close to 90°. This arrangement feels comfortable for a user.

The trigger switch 30 is located towards the first end 46 of the handgrip 28. The trigger switch 30 is located between the power source 32 and the airflow generator 36 and is capable of switching the airflow generator 36 on or off. The trigger switch has on and off positions. The trigger switch moves from left to right as seen in FIG. 2. The off position is located to the left, and the on position to the right. In the off position the trigger switch 30 is in an open state and the airflow generator 36 will be switched off. In the on position the trigger switch 30 will be closed and the airflow generator 36 will be switched on. The trigger switch 30 includes a spring 50 which biases the trigger switch 30 towards a normally open state. This arrangement allows the trigger switch 30 to be operated easily by a user's index finger. This in turn allows the hand-held vacuum cleaner 10 to be operated with one hand.

In use, a user grips the handgrip 28 to manipulate the hand-held vacuum cleaner 10 in use. When the user squeezes the trigger switch 30, the airflow generator 36 operates. The user must maintain pressure on the trigger switch 30 in order to keep the airflow generator 36 operating. This means that the user is likely to release the trigger switch 30 when he or she does not require a cleaning action, e.g. when moving from one room to another. If the user releases the trigger switch 30, the spring 50 will bias the trigger switch 30 to the off position and operation of the airflow generator 36 will cease. This reduces unnecessary use of the airflow generator 36 and results in a saving of battery life and motor life.

When operating, the airflow generator 36 draws a flow of dirt- and dust-laden air into the suction opening 16, through the suction conduit 14 and into the cyclonic separating apparatus 18. Dirt- and dust-laden air enters the upstream cyclone 20 and larger dirt and dust particles are separated by cyclonic motion. These particles are then collected in the upstream cyclone 20.

The partially-cleaned airflow then enters the plurality of downstream cyclones 22. The downstream cyclones 22 are able to separate smaller particles of dirt and dust from the partially-cleaned airflow than the upstream cyclone 20. The cleaned air exits the cyclonic separating apparatus 16 and passes sequentially through the pre-motor filter 42, the airflow generator 36 and the post-motor filter 44 before being exhausted from the hand-held vacuum cleaner 10 through the exhaust vents 26.

In use, a user may wish to clean a variety of surfaces which may be orientated at different angles. Therefore, a user will need to lift and move the hand-held vacuum cleaner 10 into a variety of positions and orientations in order to clean effectively. The location of the handgrip 28 between the airflow generator 36 and the power source 32 allows the hand-held vacuum cleaner 10 to be manipulated easily in use. This is because the user's hand will be located between the two heaviest components of the hand-held vacuum cleaner 10. This results in a "dumbbell-like" configuration in which the weight of the hand-held vacuum cleaner 10 is distributed on both sides of the user's hand.

The transverse arrangement of the longitudinal axis Y-Y of the suction conduit 14 with respect to the axis X-X of the handgrip 28 results in the suction conduit 12 forming a substantially straight extension of the user's forearm when the user's wrist is essentially straight. This arrangement feels comfortable for the user, especially when the hand held vacuum cleaner 10 is used for a period of time. Further, the location of the longitudinal axis Y-Y of the suction conduit 14 close to the centre of the hand-held vacuum cleaner 10 means that the longitudinal axis Y-Y of the suction conduit 14 will be coincident, or close to, the longitudinal axis of rotation of the user's forearm. This results in little or no axial displacement of the suction opening 14 when the hand-held vacuum cleaner 10 is rotated.

The invention is not limited to the features of the specific embodiment described above. Variations will be apparent to the person skilled in the art. For example, the specific locations of the airflow generator or power source may be varied. The airflow generator may lie above or below the handgrip. Additionally, the power source may lie directly adjacent the second end of the handgrip. The power source may lie above or below the handgrip. What is important is that the airflow generator lies directly adjacent a first end of the handgrip and the power source lies adjacent a second end of the handgrip.

The angular relationship between the longitudinal axis of the suction conduit and the axis of the handgrip can be varied. It is preferred that the angle between the longitudinal axis of the suction conduit and the axis of the handgrip is in the range of 80 to 90°. However, what is important is that these axes are transverse to one another such that the manipulation of the hand-held vacuum cleaner by a user feels comfortable.

A cyclonic separating unit need not be used. Other separating apparatus such as a bag-type filter could be used. Further, the hand-held vacuum cleaner need not be fitted with a rechargeable power source. Standard batteries or a power lead could be used. Further, the invention is not limited to hand-held vacuum cleaners. Other types of hand-held cleaning appliances could be used, for example, carpet shampooers, wet and dry machines or blower vacuum devices.

The invention claimed is:

1. A hand-held cleaning appliance comprising a suction conduit, an airflow generator generating an airflow along the suction conduit, a separating apparatus in communication with the suction conduit for separating dirt and dust from the airflow, a handgrip enabling a user to maneuver the hand-held cleaning appliance, the handgrip having a first end, a second end and a longitudinal axis, and a power source arranged adjacent the second end of the handgrip and external to the handgrip for supplying power to the airflow generator, wherein the airflow generator is arranged directly adjacent the first end of the handgrip, the longitudinal axis passes through at least a part of the airflow generator, the handgrip lies between the airflow generator and the power source, and the separating apparatus comprises a cyclonic separator.

2. The hand-held cleaning appliance of claim 1, wherein the power source is arranged directly adjacent the second end of the handgrip.

3. The hand-held cleaning appliance of claim 1 or 2, wherein the longitudinal axis passes through at least a part of the power source.

4. The hand-held cleaning appliance of claim 1 or 2, wherein the airflow generator is arranged above the handgrip and the power source is arranged below the handgrip.

5. The hand-held cleaning appliance of claim 1 or 2, wherein the suction conduit has a suction opening which is located remote from the handgrip.

6. The hand-held cleaning appliance of claim 5, wherein the separating apparatus is located between the suction opening and the handgrip.

7. The hand-held cleaning appliance of claim 1 or 2, wherein a trigger switch is located on the handgrip for switching the airflow generator on or off.

8. The hand-held cleaning appliance of claim 5, wherein a trigger switch is located on the side of the handgrip which is closest to the suction opening.

9. The hand-held cleaning appliance of claim 7, wherein the trigger switch includes a resilient member configured for biasing the trigger switch into an off position.

10. The hand-held cleaning appliance of claim 1 or 2, wherein the power source is removably attached to the second end of the handgrip.

11. A hand-held vacuum cleaner comprising the cleaning appliance of claim 1 or 2.

12. The hand-held cleaning appliance of claim 7, wherein the trigger switch is located on the side of the handgrip which is closest to the suction opening.

13. The hand-held cleaning appliance of claim 8, wherein the trigger switch includes a resilient member configured for biasing the trigger switch into an off position.

14. The hand-held cleaning appliance of claim 1, wherein the power source forms a base part of the handgrip.

15. A hand-held cleaning appliance comprising a suction conduit, an airflow generator generating an airflow along the suction conduit, a separating apparatus in communication with the suction conduit for separating dirt and dust from the airflow, a handgrip enabling a user to maneuver the hand-held cleaning appliance, the handgrip having a first end, a second end and a longitudinal axis, and a power source arranged adjacent the second end of the handgrip for supplying power to the airflow generator, wherein the airflow generator is arranged directly adjacent the first end of the handgrip, the longitudinal axis passes through at least a part of the airflow generator, the handgrip lies between the airflow generator and the power source, and the separating apparatus comprises a cyclonic separator.

16. The hand-held cleaning appliance of claim 15, wherein the power source is arranged directly adjacent the second end of the handgrip.

17. The hand-held cleaning appliance of claim 15 or 16, wherein the longitudinal axis passes through at least a part of the power source.

18. The hand-held cleaning appliance of claim 15 or 16, wherein the airflow generator is arranged above the handgrip and the power source is arranged below the handgrip.

19. The hand-held cleaning appliance of claim 15 or 16, wherein the suction conduit has a suction opening which is located remote from the handgrip.

20. The hand-held cleaning appliance of claim 19, wherein the separating apparatus is located between the suction opening and the handgrip.

21. The hand-held cleaning appliance of claim 15 or 16, wherein a trigger switch is located on the handgrip for switching the airflow generator on or off.

22. The hand-held cleaning appliance of claim 19, wherein a trigger switch is located on the side of the handgrip which is closest to the suction opening.

23. The hand-held cleaning appliance of claim 21, wherein the trigger switch includes a resilient member configured for biasing the trigger switch into an off position.

24. The hand-held cleaning appliance of claim 15 or 16, wherein the power source is removably attached to the second end of the handgrip.

25. A hand-held vacuum cleaner comprising the cleaning appliance of claim 15 or 16.

26. The hand-held cleaning appliance of claim 21, wherein the trigger switch is located on the side of the handgrip which is closest to the suction opening.

27. The hand-held cleaning appliance of claim 22, wherein the trigger switch includes a resilient member configured for biasing the trigger switch into an off position.

* * * * *